United States Patent [19]

Midgley et al.

[11] Patent Number: 4,574,188

[45] Date of Patent: Mar. 4, 1986

[54] ELONGATE ELECTRICAL ASSEMBLIES

[75] Inventors: John A. Midgley, San Carlos; Richard H. Hulett, Los Altos, both of Calif.

[73] Assignee: Raychem Corporation, Menlo Park, Calif.

[21] Appl. No.: 745,367

[22] Filed: Jun. 14, 1985

Related U.S. Application Data

[63] Continuation of Ser. No. 369,309, Apr. 16, 1982, abandoned.

[51] Int. Cl.[4] ..... H05B 3/54

[52] U.S. Cl. ..... 219/549; 219/528; 219/505; 219/553; 338/22 R; 338/214

[58] Field of Search ..... 219/504, 505, 508, 528, 219/541, 543, 544, 548, 549, 553; 338/22 R, 22 SD, 214, 23, 226; 264/104, 105, 230; 29/611; 156/86

[56] References Cited

U.S. PATENT DOCUMENTS

| | | | |
|---|---|---|---|
| 2,782,290 | 2/1957 | Lannan et al. | 338/214 X |
| 3,061,501 | 10/1962 | Dittman et al. | 219/543 X |
| 3,214,719 | 10/1965 | Turner | 338/226 X |
| 3,221,145 | 11/1965 | Hager, Jr. | 219/54 G |
| 3,397,302 | 8/1968 | Hosford | 219/528 |
| 3,501,619 | 3/1970 | Buiting et al. | 219/553 X |
| 3,535,494 | 10/1970 | Armbruster | 219/528 |
| 3,757,086 | 9/1973 | Indoe | 219/528 |
| 3,861,029 | 1/1975 | Smith-Johannsen | 29/611 |
| 3,947,799 | 3/1976 | Epaneshnikova et al. | 338/9 |
| 3,959,622 | 5/1976 | Bohdaniv et al. | 219/549 |
| 4,017,715 | 4/1977 | Whitney et al. | 219/553 |
| 4,045,763 | 8/1977 | Miyamoto et al. | 338/23 |
| 4,072,848 | 2/1978 | Johnson et al. | 219/528 |
| 4,104,509 | 9/1976 | Van Bokestal et al. | 219/544 |
| 4,107,640 | 8/1978 | Asano et al. | 338/22 R X |
| 4,117,312 | 9/1978 | Johnson et al. | 219/548 |
| 4,151,401 | 5/1977 | Van Bokestal et al. | 219/508 |
| 4,177,376 | 12/1979 | Horsma et al. | 219/553 |
| 4,246,468 | 1/1981 | Horsma | 219/553 |
| 4,272,471 | 6/1981 | Walker | 264/104 |
| 4,298,789 | 11/1981 | Eichelberger et al. | 219/543 X |
| 4,314,230 | 2/1982 | Cardinal et al. | 338/314 |
| 4,324,974 | 4/1982 | Steiner et al. | 219/553 |
| 4,334,351 | 6/1982 | Sopory | 29/611 |
| 4,341,949 | 7/1982 | Steiner et al. | 219/553 |
| 4,345,368 | 8/1982 | Goss et al. | 29/611 |
| 4,421,582 | 12/1983 | Horsma et al. | 156/86 |
| 4,436,986 | 3/1984 | Carlson | 219/505 |

FOREIGN PATENT DOCUMENTS

| | | |
|---|---|---|
| 2641894 | 3/1977 | Fed. Rep. of Germany . |
| 2715878 | 11/1977 | Fed. Rep. of Germany . |
| 1529354 | 10/1978 | United Kingdom . |
| 2014784 | 8/1979 | United Kingdom . |
| 1562086 | 3/1980 | United Kingdom . |
| 1566151 | 4/1980 | United Kingdom . |

OTHER PUBLICATIONS

Raychem Product Brochure entitled, "Autosense for Continuous Heat Trace Monitoring".

Raychem Product Brochure entitled, "Autosense for Critical Piping Networks".

Standard Handbook for Mechanical Engineers, 7th Edition, McGraw-Hill Book Co. Inc., 1967, pp. 15-86, 15-87.

*Primary Examiner*—Volodymyr Y. Mayewsky

*Attorney, Agent, or Firm*—Timothy H. P. Richardson; Herbert G. Burkard

[57] ABSTRACT

Elongate electrical devices, comprising two conductors with electrical elements connected in parallel between them, have improved performance if the power supply is connected to one conductor at the near end and to the other conductor at the far end. Particularly useful devices are heaters, e.g. PTC conductive polymer heaters. The power supply is connected to the far end of the device through a connection means whose electrical properties can be correlated with those of the device in order to obtain a wide range of useful results. For example the connection means can have PTC, NTC or ZTC character and can be a simple conductor or another elongate device. The power supply can be DC or single-phase, two-phase or three-phase AC.

33 Claims, 31 Drawing Figures

ELONGATE ELECTRICAL ASSEMBLIES

CROSS REFERENCE TO RELATED APPLICATIONS

This application is a continuation of application Ser. No. 369,309, filed on Apr. 16, 1982, now abandoned by Midgley et al, now abandoned, and is related to Application Ser. Nos. 745,350 and 745,349 which are being filed contemporaneously with this application and which are divisionals of Ser. No. 369,309. The entire disclosure of each of these applications is incorporated by reference herein. Each of these applications is copending and commonly assigned.

FIELD OF THE INVENTION

This invention relates to elongate electrical devices, especially heaters, and to circuits containing them.

INTRODUCTION OF THE INVENTION

Many elongate electrical heaters, e.g. for heating pipes, tanks and other apparatus in the chemical process industry, comprise two (or more) relatively low resistance conductors which are connected at one end to the power source and run the length of the heater, with a plurality of heating elements connected in parallel with each other between the conductors. An advantage of such heaters is that they can, if necessary, be cut to length. In one class of such heaters, the heating elements are in the form of a continuous or segmented strip of conductive polymer which lies between the conductors. In a second class, the heating elements are in the form of one or more resistive heating wires which progress down the length of the heater and are connected at intervals to alternate conductors; such heaters are usually referred to as zone heater. Zone heaters, when cut to length, have a cold spot at the cut end, the length of the cold spot depending on where the cut is made. For many uses, elongate heaters are preferably self-regulating. This can be achieved, for example, in the first class given above, by using a continuous strip of conductive polymer at least a part of which exhibits PTC behavior, and in the second class, by connecting the heating wire(s) to one or both of the conductors through a connecting element composed of a PTC material.

Although the conductors in such elongate heaters are of relatively low resistance, there is still a finite loss of potential between them as the distance from the power source increases, and this limits the length of heater which can be employed, since the power generated by the heating elements depends in part upon the potential difference between the conductors. The maximum length of such a heater can be increased by increasing the size of the conductors, but this is expensive and results in a heater which is heavier and has reduced flexibility. Another limitation of self-regulating heaters is that their resistance, when cold, is often much less than their resistance at steady state operation; consequently they draw a much larger current when they are first switched on, and therefore suffer from the problem of current inrush. Another limitation of many heaters is that they can only be powered by supply voltages within a particular range.

Elongate heaters of various kinds, and conductive polymers for use in such heaters, are disclosed in U.S. Pat. Nos. 3,861,029, 4,072,848, 4,117,312, 4,242,573, 4,246,468, 4,272,471, and 4,334,351, the disclosures of which are incorporated herein by reference.

SUMMARY OF THE INVENTION

We have now discovered that substantial improvements can be made in the performance of elongate electrical devices comprising two elongate electrical connection means and a plurality of electrical elements which are connected in parallel between them, by connecting the power supply to one of the electrical connection means at one end of the device and to the second electrical connection means at the other end of the device. When the device is connected in this way and the two connection means have the same impedance (as is usually the case), the potential drop between the two connection means is similar (and, in theory at least, can be the same) at the near end of the device as at the far end. This balancing of the potential drop over the length of the device leads to substantially improved performance. In addition, the voltage dropped over each of the elements (c) is less than the voltage dropped over the elements (c) nearest the power source when the device is connected in the conventional way. The reduction in the voltage dropped over the elements (c) is particularly marked when the third connection means has substantial impedance. Furthermore, by connecting a PTC heater in this way, any problem of current inrush can be substantially reduced. In addition, since the power supply is connected to the second connection means (at the other end of the device) through a third connection means, which can be of any kind, very valuable results can be obtained by correlation of the properties of the third connection means with the remainder of the circuit, in particular their relative impedances and their variation with temperature. Examples of suitable third electrical connection means include (1) a simple conductor, e.g a wire or metal strip, which
  (a) has an impedance which does not vary substantially in the temperature range of operation and which is substantially the same as, or substantially less than, or substantially greater than, the impedance of each of the first and second electrical connection means; or
  (b) has an impedance which decreases substantially as the temperature increases; or
  (c) has an impedance which increases substantially as the temperature increases;
(2) another electrical device comprising two elongate electrical connection means and a plurality of electrical elements which are connected in parallel between them; and
(3) when a DC power supply is used, a ground connection.

The devices used in the present invention are usually physically located so that one end of the device is nearer to the power supply than the other. Accordingly, for ease and clarity in describing and claiming the invention, the terms "near end" and "far end" are used in this specification to identify the ends of the elongate connection means and the devices containing them. It is to be understood, however, that the invention includes devices which have been arranged, e.g. in a loop, so that the "far end" is closer to the power supply than the "near end" or so that the near and far ends are equidistant from the power supply.

BRIEF DESCRIPTION OF THE DRAWINGS

The invention is illustrated by the accompanying drawings, in which

(FIG. 5 is also the equivalent circuit of FIG. 7);

FIGS. 22 to 28 are cross-sections through composite devices suitable for use in FIGS. 13 to 21; and.

DETAILED DESCRIPTION OF THE INVENTION

Figure 1:
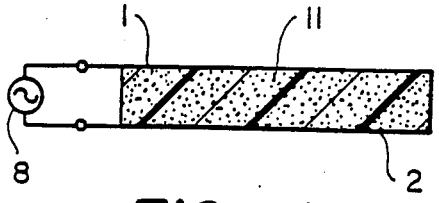
FIG 1 (PRIOR ART)
FIG. 1 is a diagrammatic view of a conventional conductive polymer strip heater which comprises conductors 1 and 2 embedded in a conductive polymer strip 11 and which is conventionally connected to a power supply 8.
Figure 2:
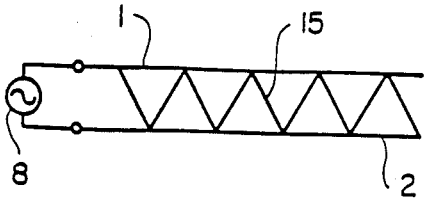
FIG 2 (PRIOR ART)
FIG. 2 is a diagrammatic view of a conventional zone heater which comprises heating wires 15 connected to conductors 1 and 2 and which is conventionally connected to a power supply 8.

For brevity and clarity in describing the present invention, the term "elongate parallel device" is used in this specification to denote an elongate electrical device which comprises (a) a first elongate electrical connection means;

(b) a second elongate electrical connection means; and (c) a plurality of electrical elements which are connected in parallel with each other between the first and second connection means.

The electrical circuits of the present invention comprise (1) an elongate parallel device; and (2) a power source which is connected to the near end of the first connection means of the device (1) and to the far end of the second connection means of the device (1).

As indicated above, a wide variety of third electrical connection means can be used to connect the power source to the far end of the second connection means. The third connection means can be physically separate from, or physically secured to (but electrically insulated from) the elongate parallel device. When it is physically secured to the elongate parallel device, many of the resulting composite devices are novel per se, i.e. whether or not the far ends of the second and third connection means are connected to each other and whether or not the device is connected to a power source. Such novel devices form part of the present invention. Thus, the composite devices of the present invention comprise (1) an elongate parallel device; and (2) a third elongate electrical connection means which is physically secured to, but electrically insulated from, the device (1);

subject to the provisos that (A) if (i) the first and second connection means of the device (1) are wire conductors and the component (c) of the device (1) is a PTC conductive polymer strip in which the conductors are embedded, (ii) the third electrical connection means is also a wire conductor, and (iii) the composite device comprises no other elongate electrical connection means; then the third connection means has a resistance at 25° C., $R_3^{25}$, which is (a) less than $0.2\times R_1^{25}$ or less than $0.2\times R_2^{25}$or (b) more than $1.2\times R_1^{25}$ or more than $1.2\times R_2^{25}$, or (c) more than $1.2\times R_3^{150}$;

where $R_1^{25}$ is the resistance of the first connection means at 25° C., $R_2^{25}$ is the resistance of the second connection means at 25° C., and $R_3^{150}$ is the resistance of the third connection means at 150° C.; and (B) if (i) the first and second connection means of the device (1) are wire conductors and the component (c) of the device (1) is a PTC conductive polymer strip in which the conductors are embedded and (ii) the third elongate electrical connection means is a second elongate electrical device comprising two elongate wire conductors embedded in a PTC conductive polymer strip, then the first and second devices are physically secured to each other by a connecting body of electrically insulating material.

The various electrical connection means will often be simple conductors, which can be composed of the same or different materials, e.g. round metal wires (which may be solid or stranded) or flat metal strips, and are sometimes simply referred to herein as conductors. It is to be understood, however, that any form of electrical connection means can be used. Generally it is desirable that in the (or each) elongate parallel device, (a) the first and second conductors are substantially the same as each other; (b) each of the conductors has substantially the same cross-section throughout the length of the device; (c) the resistance of the conductors is as low as is consistent with other factors such as weight, flexibility and cost; and (d) the conductors are at a constant distance from each other (they may be for example, straight or spiralled).

As previously noted, a characteristic feature of the present invention is that when the first and second connection means are the same, the potential drop between them is similar at the near end of the device as it is at the far end of the device. Theoretically the potential drop can be the same at the near end and the far end, but in practice, variations in electrical and/or thermal characteristics along the length of the device can result in substantial deviations from theory. Nevertheless the balancing of the potential drop along the length of the device is much better than when the near ends of the first and second connection means are connected to the power source. This improved balancing produces particularly valuable results when the device is a heater; in particular the improved power distribution enables longer circuit lengths to be used. The invention will, therefore, chiefly be described by reference to heaters. It is to be understood, however, that the invention also includes other devices, e.g sensors and fault detection systems, especially those in which benefits are derived from this balancing of the potential drop between the conductors at different points along the length of the device.

The electrical elements (c), which are connected in parallel with each other between the first and second connection means, will usually be the same as each other, but this is not necessary. In one preferred embodiment of the invention, at least some of the elements (c) comprise a PTC element, which can be composed of a conductive polymer or a ceramic. The PTC element can itself be the sole heating element; alternatively it can have a ZTC resistive heating element in series with it. The elements (c) can be in the form of at least one element composed of a conductive polymer, for example a continuous strip or web of conductive polymer or a plurality of segments of conductive polymer. The composition of the conductive polymer element may be the same throughout, or can vary; thus the conductive polymer element can comprise two or more longitudinally extending components which have different electrical characteristics. Suitable conductive polymer elements include (a) elements which consist essentially of a conductive polymer which exhibits ZTC behavior; and (b) elements which comprise a PTC conductive polymer element such that the device is a self-regulating heater, e.g. an element which consists essentially of a PTC conductive polymer or an element which comprises a ZTC component element and at least one PTC component element, for example at least one PTC component element which surrounds one of the elongate conductors.

In another preferred embodiment of the invention, the elements(c) are in the form of one or more heating wires which are connected at intervals to the two conductors, e.g. as in a conventional zone heater.

A wide variety of different effects can be obtained by correlating the electrical characteristics of the elongate parallel device and of the electrical connection means which connects the power source and the far end of the second electrical connection means of the elongate parallel device. For example, in the simplest circuits of the invention, as illustrated for example in FIGS. 3–5 and 7–8, the third connection means is a simple conductor, and the electrical character of the circuit depends very much on the relative resistances of third connection means and the components (a), (b) and (c) of the elongate parallel device and any change thereof with temperature, The impedance of the third connection means can be purely resistive or part or all of the impedance can be inductive or capacitative; for example the third connection means can be a SECT (skin effect curing tracing) heater.

In one class of circuits, the impedance of the third connection means is substantially less than, preferably less than 0.5 times, particularly less than 0.2 times, the impedance of each of the first and second conductors, at least at room temperature and generally also at higher temperatures, e.g. throughout the range 25° to 200° C., and preferably at all temperatures likely to be encountered in use of the device.

In a second class of circuits, the impedance of the third connection means is substantially the same as e.g. 0.9 to 1.1 times, the impedance of each of the first and second conductors, at least at room temperature and generally also at higher temperatures, e.g. throughout the range 25° to 200° C., and preferably also at all temperatures likely to be encountered in use of the device.

In a third class of circuits, the impedance of the third connection means is substantially greater than, preferably more than 1.2 times, especially more than 2 times, e.g. 2 to 20 times, particularly more than 3 times, e.g. 3 to 15 times, the impedance of each of the first and second conductors, at least at room temperature and generally also at higher temperatures, e.g. throughout the range 25° to 200° C., and preferably at all temperatures likely to be encountered in use of the device. In such circuits, the third connection means functions as a series heater, thus contributing to the power output of the heater. Under normal (i.e. steady state) operating conditions, the ratio of the impedance of (and usually but not necessarily the heat generated by) the third connection means to the impedance (and usually but not necessarily the heat generated by) the parallel heater may be, for example, from 0.05 to 20, preferably 0.1 to 2.0, particularly 0.1 to 0.5. If the parallel heater is a PTC heater, there may be some loss of the local self-regulating characteristic of a conventional PTC heater, because the third connection means continues to generate heat until the whole of the PTC heater has been converted to the high impedance state. Under the expected operating conditions of the heater, therefore, the heat output of the PTC heater is preferably 2 to 15 times the heat output of the third connection means. The use of a relatively high impedance third connection means also results in a substantially lower proportion of the applied voltage being dropped over the elements (c) of the elongate parallel device.

In a fourth class of circuits, the third connection means has an impedance which increases with temperature. The increase can be small, as in a conventional resistance wire heater, e.g. the impedance at 300° C. can be 1.2 to 2 times the impedance at 25° C. Alternatively, the increase can be relatively large, as in an elongate parallel device as defined in which the components (c) are provided by a PTC conductive polymer strip, for example the impedance at a temperature below 300° C. can be at least 10 times its impedance at 25° C.

In a fifth class of circuits, the third connection means has an impedance which decreases with temperature, e.g. which at 150° C. is less than 0.8 times, preferably less than 0.2 times, its impedance at 25° C. Such a third connection means can control current inrush without having substantial impedance under normal operating conditions.

Figure 11:
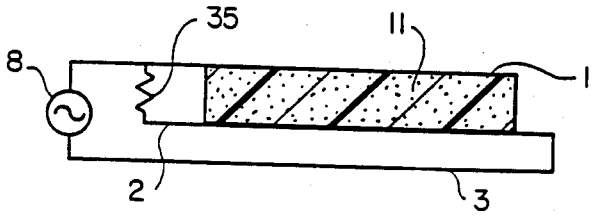
FIG. 11 is the same as FIG. 3, except that the near ends of the first and second conductors are connected to each other through a resistor 35.

In a sixth class of circuits, a fixed resistance is connected between the near ends of the first and second connection means of the elongate parallel device, which is preferably a self-regulating heater. Such a circuit is illustrated in FIG. 11. The resistance is preferably selected so that it is substantially higher than the impedance of the heater at 25° C. and comparable with it (e.g. 0.5 to 5 times) at normal operating temperatures; in this way, the voltage dropped over the parallel-connected elements at normal operating conditions is reduced.

Figure 12:
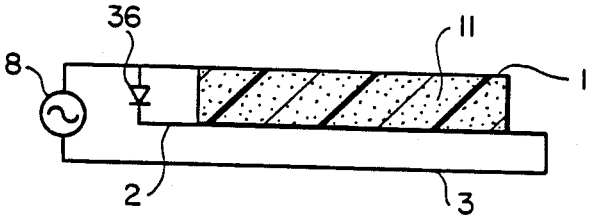
FIG. 12 is the same as FIG. 3 except that the near ends of the conductors 1 and 2 are connected to each other through a voltage-limiting device 36, e.g. a Zener diode.

In a seventh class of circuits, a voltage-limiting device, e.g. a Zener diode, is connected between the near ends of the first and second connection means of the parallel device, which is preferably a heater. A circuit of this kind is illustrated in FIG. 12. The voltage-limiting device ensures that the voltage dropped over the parallel-connected elements cannot exceed a predetermined value.

As indicated above, the third elongate connection means can itself be an elongate parallel device as defined, and the invention includes a number of particularly useful circuits which comprise a two or three phase power supply and two or three elongate parallel devices as defined; these deivces are preferably the same, but can be different. Many, but not all, of these circuits comprise a neutral, and when they do, the neutral is preferably provided by an elongate electrical connection means. However, it is also possible to use a floating neutral.

Figure 13:
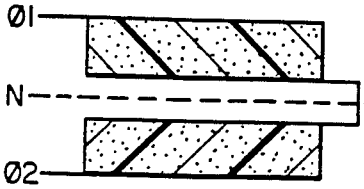
FIGS. 13 to 17 are circuits in which two conductive polymer PTC heaters are connected to a two phase power source to form circuits of the invention.
Figure 14:
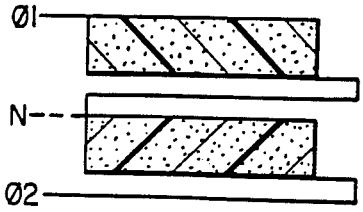
Figure 15:
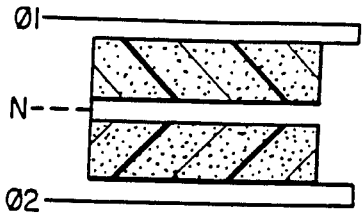
Figure 16:
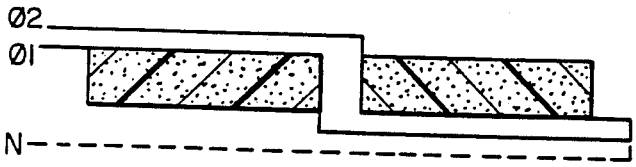
Figure 17:
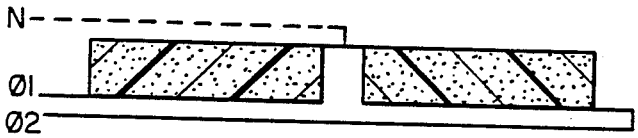
Figure 18:
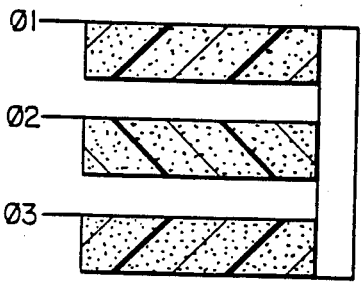
FIGS. 18 to 21, 30 and 31 are circuits in which three conductive polymer PTC heaters are connected to a three phase power source to form circuits of the invention.
Figure 19:
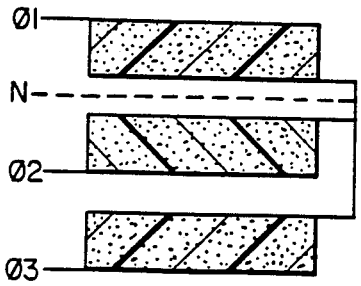
Figure 20:
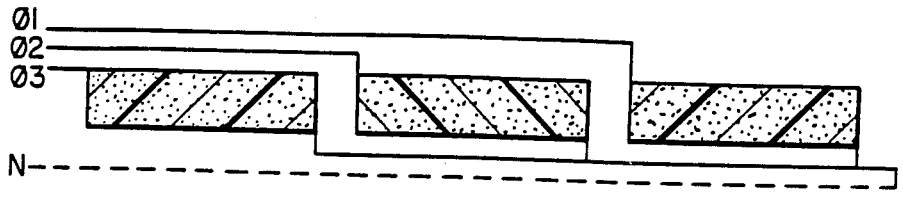
Figure 21:
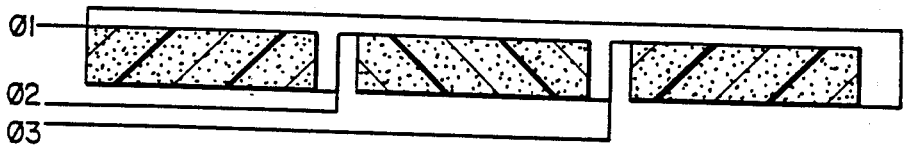

An eighth class of circuits of the invention comprises (1) a two phase power source;

(2) a first elongate parallel device as defined; and (3) a second elongate parallel device as defined;

one end of one of the connection means of the first device being connected to the first phase of the power source; the opposite end of the other connection means of the first device being connected to one end of one of the connection means of the second device; and the opposite end of the other connection means of the second device being connected to the second phase of the power source. Preferably the circuit also includes a further electrical connection means which connects the neutral of the power source to the connection between the two devices. Various circuits of this kind are shown in FIGS. 13 to 17, in which the neutral connection which is preferably present is shown as a broken line. Preferred circuits (because they are balanced) are those in hich the near ends of the first connection means of the two elongate parallel devices are connected to the first and second phases respectively of the power supply and the far ends of the second connection means of the two devices are connected to each other and to the neutral of the power supply, as shown in FIG. 13 for devices which are physically located side-by-side and in FIG. 16 for devices which are physically located end-to-end.

Figure 30:
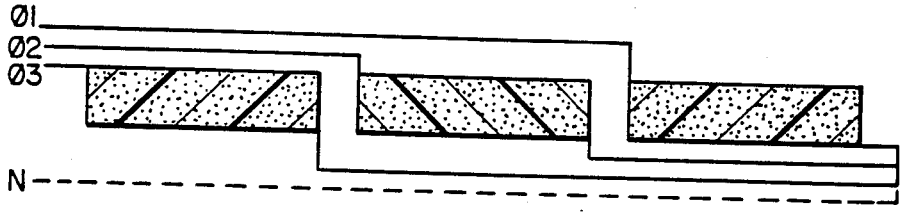
Figure 31:
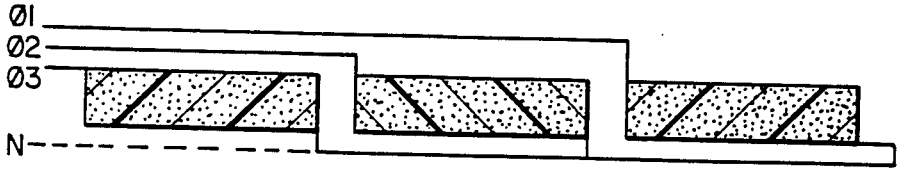

A ninth class of circuits of the invention comprises (1) a three phase power source;

(2) a first elongate parallel device as defined;

(3) a second elongate parallel device as defined; and (4) a third elongate parallel device as defined;

one end of one of the connection means of each of the first, second and third devices being connected to the first, second or third phase of the power source, and the other ends of the other connection means of each of the devices being connected to a different phase (delta connection) or to each other (star connection). When the other ends are connected to each other, there is a neutral point in the circuit and the circuit preferably includes a further electrical connection means which connects the neutral point and the neutral of the power source. However, a floating neutral can also be used. Various circuits of this kind are shown in FIGS. 18 to 21, 30 and 31, in which the preferred neutral connection is shown as a broken line. FIG. 30 is a particularly preferred, balanced circuit.

When the circuits of the eighth and ninth classes comprise an elongate connection means which carries the circuit current, as in FIGS. 14 to 17, 20, 21 and 31, then the impedances of the connection means and of the elongate devices (and their variation, if any, with temperature) can be correlated in order to obtain desired results, as generally discussed above.

In FIGS. 13 to 21, 30 and 31 the various heaters are shown as conductive polymer heaters, but the same circuits are very suitable for use with zone heaters and other elongate parallel heaters.

When the elongate parallel devices, in the circuits of the eighth and ninth classes, are physically located side-by-side, they can be separate from each other or physically secured to each other. The various elongate connection means needed to complete the different circuits can likewise be separate from the other circuit components or physically secured to one or more of them.

Composite devices which can be used in the circuits of the eighth and ninth classes include those defined in paragraphs (1) and (2) below. Cross-sections of particular Examples of such devices are shown in FIGS. 22 to 28, in each of which a tube 41 of insulating polymeric material physically connects at least one PTC conductive polymer heater (101, 102 and 103) having an insulating polymeric jacket and at least one wire conductor (111, 112, 113 and 114) having an insulating polymeric jacket.

Figure 22:
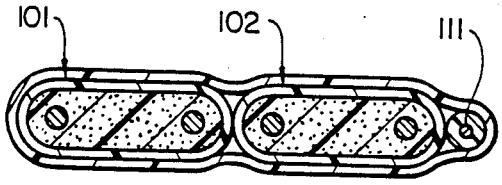
Figure 23:
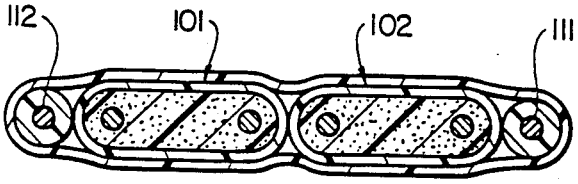
Figure 24:
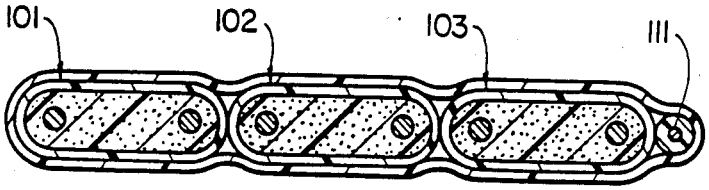

(1) Composite devices which comprise at least two elongate parallel devices as defined, and which can also include one or more elongate connection means. FIGS. 22, 23 and 24 show devices of this type. The device of FIG. 22 is suitable for use in the circuit of FIG. 13; it is to be noted that the neutral connection means 111 in FIG. 22 (and likewise in FIGS. 24, 25, 26 and 27) can be smaller than the conductors in the heaters themselves. The device of FIG. 23 is suitable for use in the circuit of FIGS. 14 and 15. The device of FIG. 24 is suitable for use in the circuit of FIG. 19.

Figure 25:
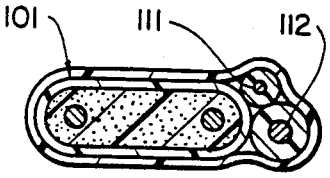
Figure 26:
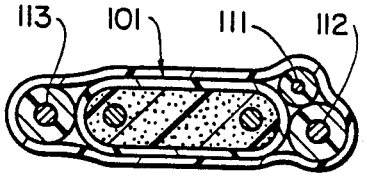
Figure 27:
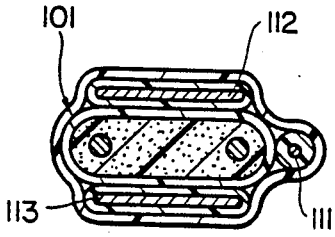
Figure 28:
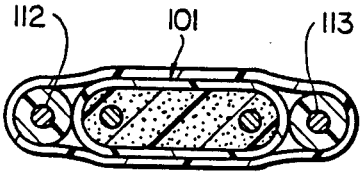

(2) Composite devices which comprise at least one elongate parallel device as defined and at least two elongate connection means. FIGS. 25, 26, 27 and 28 show devices of this type. The device of FIG. 25 is suitable for use in FIG. 16, and also in FIG. 17, with the smaller conductor not being used in the part of the circuit furthest from the power source. The devices of FIGS. 26 and 27 are suitable for use in FIG. 30, and also in FIG. 20, with one of the large conductors not being used in the part furthest form the power source, and also in FIG. 31, with the small conductor not being used in the mid-section and with the small conductor and one of the large conductors not being used in the section furthest from the power source. The device of FIG. 28 is suitable for use as the middle portion of the circuit of FIG. 21.

EXAMPLES

Figure 3:
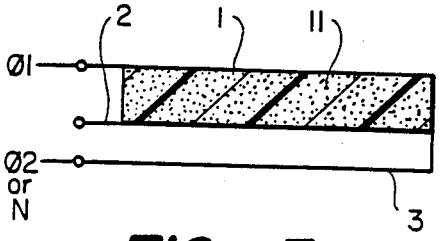
FIG. 3 is a diagrammatic view of a conductive polymer strip heater as in FIG. 1 which is connected to a power supply through a third connection means 3 to provide a circuit of the invention.
Figure 4:
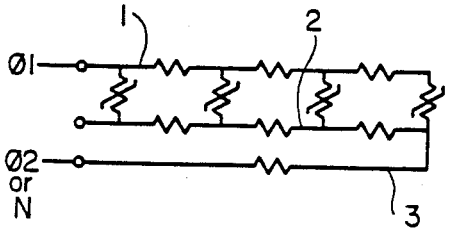
FIGS. 4 and 5 are equivalent circuits of FIG. 3 when the conductive polymer exhibits PTC behavior and ZTC behavior respectively.
Figure 5:
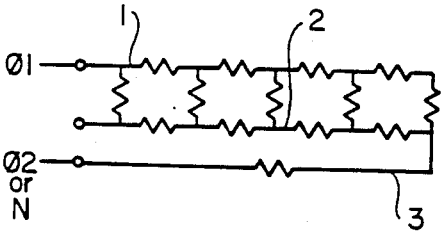
Figure 6:
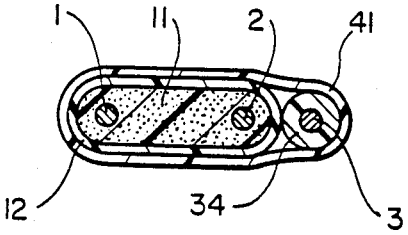
FIG. 6 is a cross-section through a composite device which comprises a heater and a third connection means as shown diagrammatically in FIG. 3, the heater and the connecting means being provided with insulating polymeric jackets 12 and 34 respectively, and also comprising polymeric insulating body 41 which connects the heater and the connection means.
Figure 7:
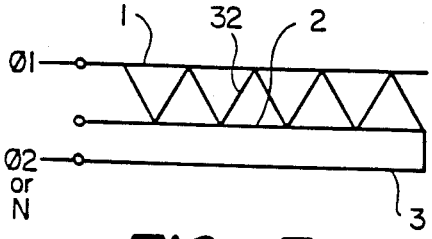
FIG. 7 is a diagrammatic view of a zone heater in which heating wires 32 are connected to conductors 1 and 2 and which is connected to a power source to provide a circuit of the invention
Figure 8:
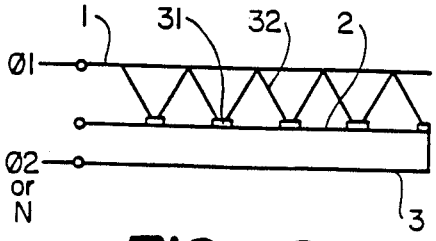
FIG. 8 is a diagrammatic view of a zone heater in which heating wires 32 are connected to conductors 1 and 2 through PTC components 31 and which is connected to a power source to provide a circuit of the invention.
Figure 9:
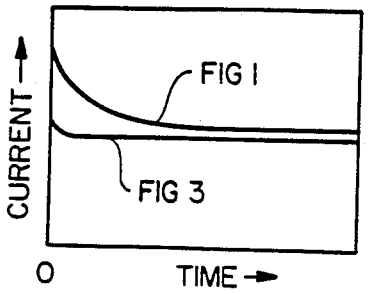
FIG. 9 shows the current in the circuit of FIG. 1 and in the circuit of FIG. 4 as a function of time immediately after the circuit has been completed.
Figure 10:
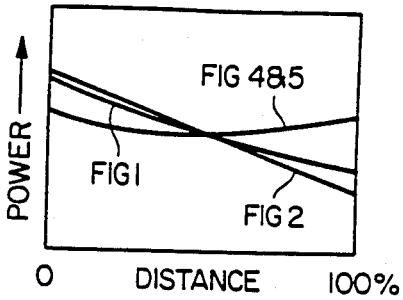
FIG. 10 shows how power is generated, during steady state operation of the circuits of FIGS. 1, 2, 4 and 5, between the two ends of the heater.
Figure 29:
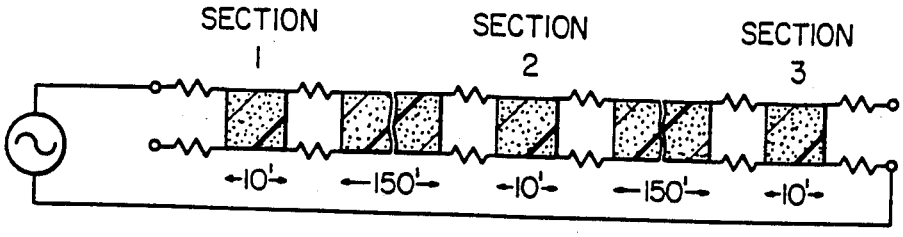
FIG. 29 is a diagrammatic view of a test circuit used in the Examples.

The invention is illustrated in the following Examples, in which Example 1 is a Comparative Example. In these Examples the power source was 120 volts AC and the heater was a self-regulating conductive polymer strip heater available from Raychem Corporation under the trade designation 10PTV1. The heater comprised a pair of 18 AWG tin-coated copper stranded wire electrodes embedded in a strip of PTC conductive polymer comprising carbon black dispersed in radiation cross-linked poly(vinylidene fluoride). The heater had a passive power of about 9 watts/foot. The heater was cut into sections which were, successively, 10, 150, 10, 150 and 10 feet long. Resistors of small but precisely known resistance were used to connect the wire electrodes of the different sections. In the Examples, the potential drop over each of these resistors was measured and hence the currents flowing in the different parts of the connection means were calculated. In Examples 1 and 2, only the first 170 feet of the heater were used (the remainder being disconnected) and in Example 3 the whole 330 feet of the heater were used. In Example 1, which is a comparative Example not in accordance with the invention, the first 170 feet of the heater was connected to the power supply in the conventional way (as shown in FIG. 1). In Examples 2 and 3, the heater was connected to the power supply in accordance with the invention (as shown in FIG. 3), using a third connection means which was an insulated 18 AWG tin-coated copper stranded wire and which was secured to the heater as shown in FIG. 6. In each of the Examples, the heater and the third connection means were secured by adhesive tape to a 2 inch diameter steel pipe having water at about 9° C. circulating through it, and were then covered with 1 inch thick thermal insulation. The assembly used in Example 3 is shown diagrammatically in FIG. 29, from which it will be noted that the 10 foot heater section nearest the power source is designated Section 1, that the 10 foot heater section 160 feet from Section 1 is designated Section 2, and that the 10 foot heater section furthest from the power source is designated Section 3. The assembly used in Example 2 was as shown in FIG. 29 except that the third wire was connected to the end of Section 2.

The results obtained in the Examples are summarized in the Table below, which shows the Inrush Factor (i.e. the ratio of the current to the steady state current) initially and after 10, 60 and 120 seconds; the current (in amps) in each bus wire (electrode) in each of Sections 1, 2 and 3; the voltage drop (in volts) between the bus wires in each of Sections 1, 2 and 3 and the power generated (in watts/foot) in (a) the bus wires of the heater (b) the conductive polymer element in the heater, (c) the third wire in the assembly, and (d) in total, in each of Sections 1, 2 and 3.

The various figures given in the Table below reflect the fact that the Examples were made with a view to obtaining a qualitative rather than quantitative assessment of the benefits of the present invention. No undue reliance should, therefore, be placed on the precise relationships between the different figures. However, the figures clearly demonstrate that by connecting the power source to the far end of the heater through a third connection means, there is obtained a reduction in current inrush, a more even power distribution along the length of the heater and a reduction in the voltage dropped across the conductive polymer strip.

TABLE

| Ex. | Length | 3rd Wire | Inrush Factor after (secs) | | | | Current in Section | | | Voltage in Section | | | Power in Bus Wires in Section | | | Power in Cond. Pol. in Section | | | Power in Third Wire in Section | | | Total Power in Section | | |
|---|---|---|---|---|---|---|---|---|---|---|---|---|---|---|---|---|---|---|---|---|---|---|---|---|
| No. | (ft) | (gauge) | Initial | 10 | 60 | 120 | (1) | (2) | (3) | (1) | (2) | (3) | (1) | (2) | (3) | (1) | (2) | (3) | (1) | (2) | (3) | (1) | (2) | (3) |
| 1 | 170 | None | 1.6 | 1.4 | 1.1 | 1.1 | 16 | 1 | — | 120 | 100 | — | 3.8 | 0 | — | 10.5 | 11 | — | — | — | — | 14.3 | 11 | — |
| 2 | 170 | 18 | 1.4 | 1.3 | 1.1 | 1.0 | 15 | 15 | — | 93 | 93 | — | 1.7 | 2.0 | — | 8.7 | 9.1 | | 1.6 | 1.6 | — | 12 | 12.7 | — |
| 3 | 330 | 18 | 1.2 | 1.1 | 1.1 | 1.0 | 19 | 10 | 19 | 52 | 42 | 53 | 2.7 | 1.5 | 3.1 | 3.3 | 2.2 | 3.3 | 2.6 | 2.6 | 2.6 | 8.6 | 6.3 | 9.0 |

We claim:

1. An electrical circuit which comprises (1) an elongate self-regulating heater which is at least 330 feet in length and which comprises (a) a first elongate electrical connection means having a near end and a far end;

(b) a second elongate electrical connection means having a near end and a far end; and (c) a plurality of electrical heating elements, each of said heating elements having a thermal output which decreases with temperature, whereby the heater is self-regulating, said heating elements being connected in parallel with each other between the first and second electrical connection means; and (2) a third elongate electrical connection means which has a near end and a far end, the far end being electrically connected to said second connection means at its far end and the remainder of the third connection means being insulated from the heater; and (3) a source of electrical power which is physically located near the near ends of the connection means and which is connected to the near end of the first connection means and to the near end of the third connection means;

whereby current inrush is reduced and power is distributed more evenly along the length of the heater.

2. A circuit according to claim 1 wherein the electrical elements (c) comprise a continuous strip of a PTC conductive polymer.

3. A circuit according to claim 1 wherein the heater is a zone heater.

4. A circuit according to claim 1 wherein the impedance of the third connection means is less than 0.5 times the impedance of the first connection means and less than 0.5 times the impedance of the second connection means.

5. A circuit according to claim 1 wherein at all temperatures in the range 25° to 200° C., the impedance of the third connection means is 0.9 to 1.1 times the impedance of the first connection means and 0.9 to 1.1 times the impedance of the second connection means.

6. A circuit according to claim 1 wherein at 25° C. the impedance of the third connection means is more than 2 times the impedance of the first connection means and more than 2 times the impedance of the second connection means.

7. A circuit according to claim 6 wherein under the normal steady state operating conditions of the circuit, the impedance of the third connection means is more than 3 times the impedance of the first connection means and more than 3 times the impedance of the second connection means.

8. A circuit according to claim 7 wherein under the normal steady state operating conditions of the circuit, the ratio of the heat generated by the third connection means to the heat generated by the heater is from 2 to 15.

9. A circuit according to claim 6 wherein the impedance of the third connection means at 150° C. is less than 0.2 times its impedance at 25° C.

10. A circuit according to claim 1 wherein the impedance of the third connection means at 300° C. is 1.2 to 2 times its impedance at 25° C.

11. A circuit according to claim 1 wherein the impedance of the third connection means at a temperature between 25° C. and 300° C. is at least 10 times its impedance at 25° C.

12. A circuit according to claim 1 wherein the impedance of the third connection means at 150° C. is less than 0.2 times its impedance at 25° C.

13. A circuit according to claim 1 wherein the third connection means comprises a second elongate electrical device which comprises (a) a first elongate electrical connection means having a near end and a far end which is connected to the far end of the second connection means of the first device;

(b) a second elongate electrical connection means having a near end which is connected to the power source and a far end; and (c) a plurality of electrical elements which are connected in parallel with each other between the first and second electrical connection means.

14. A circuit according to claim 1 wherein a fixed resistor is connected between the near ends of the first and second connection means, the fixed resistor having a resistance which is substantially higher than the impedance of the heater at 25° C. and 0.5 to 2 times the impedance of the heater under the normal steady state operating conditions of the circuit.

15. A circuit according to claim 1 wherein a voltage-limiting device is connected between the near ends of the first and second connection means.

16. A circuit according to claim 1 wherein the power source is an AC power source.

17. A circuit according to claim 1 wherein the third connection means is physically secured to the heater.

18. An electrical circuit according to claim 1 which comprises an insulating jacket which encloses said heater and third connection means.

19. A circuit according to claim 18 further comprising a second insulating jacket which encloses one only of said heater and said third connection means.

20. A circuit according to claim 18 wherein the heater is a zone heater.

21. A circuit according to claim 18 wherein the impedance of the third connection means is less than 0.5 times the impedance of the first connection means and less than 0.5 times the impedance of the second connection means.

22. A circuit according to claim 18 wherein at all temperatures in the range 25° to 200° C., the impedance of the third connection means is 0.9 to 1.1 times the impedance of the first connection means and 0.9 to 1.1 times the impedance of the second connection means.

23. A circuit according to claim 18 wherein at 24° C. the impedance of the third connection means is more than 2 times the impedance of the first connection means and more than 2 times the impedance of the second connection means.

24. A circuit according to claim 23 wherein under the normal steady state operating conditions of the circuit, the impedance of the third connection means is more than 3 times the impedance of the first connection means and more than 3 times the impedance of the second connection means.

25. A circuit according to claim 24 wherein said device is a self-regulating heater and under the normal steady state operating conditions of the circuit, the ratio of the heat generated by the third connection means to the heat generated by the device is from 2 to 15.

26. A circuit according to claim 18 wherein the impedance of the third connection means at 150° C. is less than 0.2 times its impedance at 25° C.

27. A circuit according to claim 18 wherein the impedance of the third connection means at 300° C. is 1.2 to 2 times its impedance at 25° C.

28. A circuit according to claim 18 wherein the impedance of the third connection means at a temperature between 25° C. and 300° C. is at least 10 times its impedance at 25° C.

29. A circuit according to claim 18 wherein the impedance of the third connection means at 150° C. is less than 0.2 times its impedance at 25° C.

30. A circuit according to claim 18 wherein the third connection means comprises a second elongate electrical device which comprises (a) a first elongate electrical connection means having a near end and a far end which is connected to the far end of the second connection means of the first device;

(b) a second elongate electrical connection means having a near end which is connected to the power source and a far end; and (c) a plurality of electrical elements which are connected in parallel with each other between the first and second electrical connection means.

31. A circuit according to claim 18 wherein said device is a self-regulating heater and a fixed resistor is connected between the near ends of the first and second connection means, the fixed resistor having a resistance which is substantially higher than the impedance of the heater at 25° C. and 0.5 to 2 times the impedance of the heater under the normal steady state operating conditions of the circuit.

32. A circuit according to claim 18 wherein said device is a heater and a voltage-limiting device is connected between the near ends of the first and second connection means.

33. A circuit according to claim 18 wherein the power source is an AC power source.

* * * * *